US006862518B2

(12) United States Patent
Schwabe et al.

(10) Patent No.: US 6,862,518 B2
(45) Date of Patent: Mar. 1, 2005

(54) METHOD FOR MONITORING A COOLANT CIRCUIT OF AN INTERNAL COMBUSTION ENGINE

(75) Inventors: Juergen Schwabe, Leinfelden-Echterdingen (DE); Peter Wiltsch, Wimsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/332,325

(22) PCT Filed: Apr. 17, 2002

(86) PCT No.: PCT/DE02/01414

§ 371 (c)(1),
(2), (4) Date: Jan. 7, 2003

(87) PCT Pub. No.: WO02/092976

PCT Pub. Date: Nov. 21, 2002

(65) Prior Publication Data

US 2003/0197605 A1 Oct. 23, 2003

(30) Foreign Application Priority Data

May 12, 2001 (DE) ..... 101 23 106

(51) Int. Cl.[7] ..... G06F 19/00
(52) U.S. Cl. ..... 701/114; 123/41.05; 73/116
(58) Field of Search ..... 701/114; 123/41.05, 123/41.1, 41.31, 41.46, 41.47; 73/116, 117.3, 118.1

(56) References Cited

U.S. PATENT DOCUMENTS 4,580,531 A * 4/1986 N'Guyen ..... 123/41.1
5,020,007 A 5/1991 Wu et al. ..... 73/116
6,230,553 B1 * 5/2001 Uchiyama et al. ..... 73/118.1

FOREIGN PATENT DOCUMENTS

DE 41 09 498 A1 9/1992
DE 44 26 494 A 2/1996

OTHER PUBLICATIONS

Patent Abstracts of Japan vol. 013, No. 020 (M–785), Jan. 18, 1989 & JP 63 230942 A, Sep. 27, 1988.
Patent Abstracts of Japan vol. 013, No. 163 (M–816), Apr. 19, 1989 & JP 01 003220 A, Jan. 9, 1989.

* cited by examiner

*Primary Examiner*—Hieu T. Vo
(74) *Attorney, Agent, or Firm*—Michael J. Striker

(57) ABSTRACT

In the method of monitoring a cooling fluid circuit of an internal combustion engine with setting a first error signal if a deviation of an actual value of a temperature from a desired value of the temperature exceeds a predetermined amount, a second error signal is set, which indicates a possible lack of antifreeze if a starting temperature is below the freezing point of water, a first error signal was present, the first error signal is no longer present after a predetermined time which is a function of the engine starting temperature and a build-in energy balance exceeds a threshold which is a function of the engine starting temperature.

2 Claims, 1 Drawing Sheet

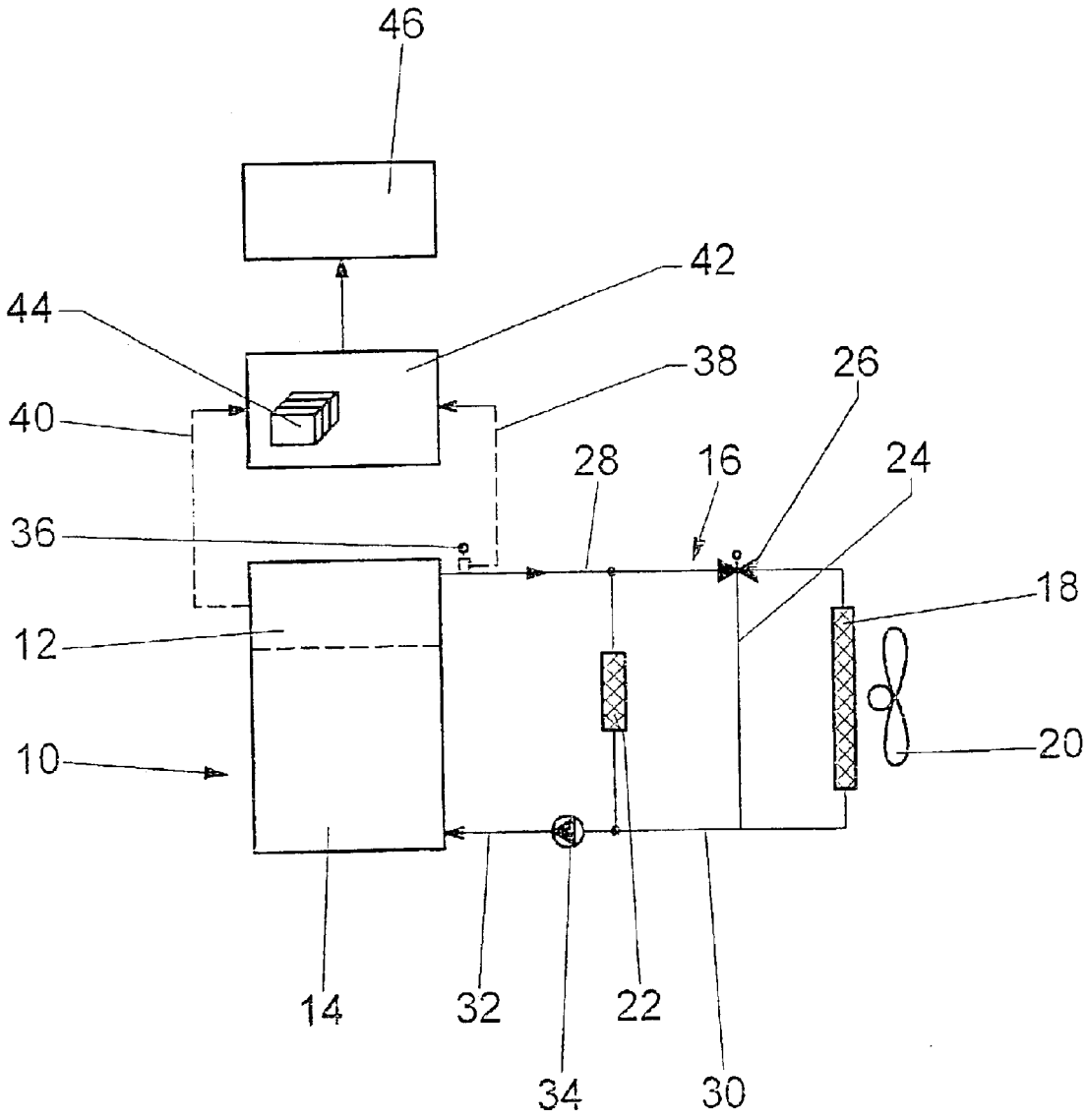
46
42
44
38
26
40
28
16
24
36
18
12
20
10
14
32
22
34
30

METHOD FOR MONITORING A COOLANT CIRCUIT OF AN INTERNAL COMBUSTION ENGINE

BACKGROUND OF THE INVENTION

The invention is based on a method for monitoring a cooling fluid circuit of an internal combustion engine.

In current reciprocating piston internal combustion engines for motor vehicles, the heat transmitted from a wall of a combustion chamber to a cylinder head and cylinder block is essentially dissipated by means of a cooling fluid. This fluid is circulated in a cooling fluid circuit by a pump, which is as a rule mechanically driven by the internal combustion engine. There are also designs in which a controllable electric motor is used as a pump drive unit in order to produce a cooling as needed.

A regulating valve distributes the volumetric flow of the cooling fluid to a radiator and a bypass line, which is provided parallel to the radiator. In addition to the radiator, a heat exchanger for the passenger compartment is also connected to the cooling fluid circuit. A desired value for the temperature of the cooling fluid, possibly controlled by means of a characteristic field, is set so that the permissible temperatures of the components to be cooled and of the cooling fluid are never exceeded during operation.

DE 41 09 498 A1 has disclosed a device and a method for a very sensitive regulation of the temperature of an internal combustion engine. To this end, a control device is supplied with a number of input signals, e.g. the temperature of the engine, the speed and load of the engine, the vehicle speed, the operating state of an air conditioning system or heater of the motor vehicle, and the temperature of the cooling water. A desired value transmitter of the control unit takes the input signals into account when establishing a desired value for the temperature of the engine. According to a comparison of the actual values to the desired values, the control unit controls a three-way valve, which is disposed in the mouth region of a bypass line in a line between the engine and a radiator.

Depending on the position of the three-way valve, the inlet flow is distributed to the cooling circuit and the bypass line. Therefore a cooling of the engine is detected not only as a function of operating parameters that are of direct significance to the temperature build-up, but also as a function of parameters of additional units, which only influence the temperature indirectly. Furthermore, the possibilities for setting the optimal temperature are broadened significantly since malfunctions can also be detected and taken into account. The association of different operating conditions with different ranges of desired values of the temperature permits the desired temperature to be quickly adjusted, which can be further refined through different priorities of the operating conditions.

In order to detect a defect in the cooling circuit, e.g. a defect in a temperature sensor, there are a variety of strategies, for example short circuit detection or plausibility analyses using a modeled comparison temperature. In this modeling, the measured, possibly distorted, temperature of the engine is compared to a model that depends on the energy throughput. If the measured temperature falls below the modeled temperature by a definite amount, then an error is stored and displayed.

If the cooling fluid is partially frozen due to insufficient antifreeze, without any damage as yet to the engine, then the control unit detects a nearly constant temperature below the freezing point until the cooling water has thawed. It can take up to 200 seconds for the cooling water to thaw. But since the model temperature presupposes that after a certain delay, the temperature of the cooling fluid increases, after a short time, an error is stored, which indicates a defective sensor or defective wiring. But the actual cause is the lack of antifreeze in the cooling fluid.

SUMMARY OF THE INVENTION

According to the invention, a second error signal is set, which indicates a possible lack of antifreeze if a starting temperature of the engine is below the freezing point of water, a first error signal was present, the error signal is no longer present after a predetermined time, which is a function of the starting temperature of the engine, and a built-in energy balance exceeds a threshold, which is a function of the starting temperature of the engine.

The method according to the invention permits the actual cause of the error message, namely the lack of antifreeze, to be eliminated in the repair shop instead of a large amount of time being wasted searching for malfunctions in the temperature sensor or in the wiring. Sometimes in such circumstances, the temperature sensor is replaced based solely on suspicion, which incurs high costs. Improving the antifreeze provides better protection of the engine at low temperatures. In addition, the operating temperature is reached more quickly than when the cooling fluid is frozen; this improves the emissions levels. The functions with regard to the predetermined time and threshold are suitably stored as characteristic fields in the control unit.

BRIEF DESCRIPTION OF THE DRAWING

Other advantages ensue from the following description of the drawing. The drawing shows an exemplary embodiment of the invention. The drawing, the specification, and the claims contain numerous features in combination. One skilled in the art will also suitably consider the features individually and will unite them in other meaningful combinations.

The sole FIGURE shows a schematic depiction of an internal combustion engine with a cooling circuit.

DESCRIPTION OF THE PREFERRED EMBODIMENTS

An internal combustion engine 10 in the form of a reciprocating piston engine has a cylinder block 14 and a cylinder head 12, which are connected to a cooling fluid circuit 16. This cooling fluid circuit 16 includes a cooling fluid pump 34, which delivers the cooling fluid from a suction line 30 via a pressure line 32, through the cylinder block 14, the cylinder head 12, a return line 28, and a radiator 18. A fan 20 conveys cooling air through the radiator 18. A bypass line 24 is provided parallel to the radiator 18, wherein a regulating valve 26, which is disposed at the branch of the bypass line 24 from the return line 28, distributes the cooling fluid flow to the radiator 18 and the bypass line 24. In addition, a heat exchanger 22 for the passenger compartment of a motor vehicle is connected parallel to the radiator 18 and the bypass line 24. However, the cooling circuit 16 can also contain other radiators, cooling fluid pumps, regulating valves, and cooling branches, which are not shown in detail here since the method according to the invention is suitable for all types of cooling circuits.

At the outlet of the cylinder head 12 of the engine 10, a temperature sensor 36 is provided, which is connected via signal lines 38 to an electronic control unit 42 and sends signals to the control unit 42 depending on the temperature of the cooling fluid. The control unit 42 receives other signals via other signal lines 40, from which it determines the operating behavior of the engine 10, for example the energy throughput. Through the use of characteristic fields 44, which are stored in the control unit 42, a temperature model is established, which supplies desired values for the temperature. The desired values are compared to the actual value of the temperature. The control unit 42 sets a first error signal, which can be displayed on a display device 46 and is stored in the memory of a control unit 42 if the deviation of the actual value of the cooling fluid temperature from the desired value exceeds a preset amount.

According to the invention, a second error signal is now set, which can also be displayed on the display device and is stored in the memory of the control unit 42; this second error signal indicates a possible lack of antifreeze if the starting temperature of the engine 10 is below the freezing point of water, a first error signal has been set, and the first error signal is no longer present after a predetermined time, which is a function of the starting temperature of the engine 10. Finally, a check is made as to whether a built-in energy balance exceeds a threshold, which is a function of the starting temperature of the engine 10. Functions of time and threshold are stored in characteristic fields 44 in the control unit 42 as a function of the starting temperature of the engine.

Under some circumstances, it is sufficient to check whether a built-in energy balance of the engine exceeds a threshold, thus rendering it no longer necessary to check whether the first error signal is still present after a predetermined time.

What is claimed is:

1. A method for monitoring a cooling fluid circuit (16) of an internal combustion engine (10), in which an electronic control unit (42) compares a measured actual value of a temperature of the engine (10) to a desired value of the temperature, which is determined from a stored model that depends on the energy throughput of the engine (10), and the control unit (42) sets a first error signal if the deviation of the actual value of the temperature from the desired value of the temperature exceeds a predetermined amount, characterized in that a second error signal is set, which indicates a possible lack of antifreeze if a starting temperature is below the freezing point of water, a first error signal was present, the first error signal is no longer present after a predetermined time, which is a function of the starting temperature of the engine (10), and a built-in energy balance exceeds a threshold, which is a function of the starting temperature of the engine (10).

2. The method according to claim 1, characterized in that the functions of the predetermined time and the threshold are stored as characteristic fields (44) in the control unit (42).

* * * * *